United States Patent [19]

Burch

[11] 4,424,506

[45] Jan. 3, 1984

[54] SNAP-ACTING MECHANISMS

[75] Inventor: Lyndon W. Burch, Boston, Mass.

[73] Assignee: B/K Patent Development, Inc., Highland Park, Ill.

[21] Appl. No.: 315,624

[22] Filed: Oct. 28, 1981

Related U.S. Application Data

[63] Continuation-in-part of Ser. No. 304,866, Sep. 23, 1981.

[51] Int. Cl.[3] ..... H01H 37/54

[52] U.S. Cl. ..... 337/365; 337/379; 200/67 D; 200/67 DA

[58] Field of Search ..... 337/343, 347, 360, 365, 337/368, 379; 200/67 R, 67 D, 67 DA, 67 DB, 251, 283

[56] References Cited

U.S. PATENT DOCUMENTS

| | | | |
|---|---|---|---|
| Re. 28,578 | 10/1975 | Burch et al. | 200/67 DA |
| 2,202,681 | 5/1940 | Allen | 200/67 DA |
| 2,533,671 | 12/1950 | Jacobs | 200/67 DA |
| 3,306,998 | 2/1967 | Russell | 200/67 DB |
| 4,214,136 | 7/1980 | Rossi et al. | 200/67 DA |

FOREIGN PATENT DOCUMENTS

| | | | |
|---|---|---|---|
| 924465 | 3/1955 | Fed. Rep. of Germany | 200/67 D |

*Primary Examiner*—George Harris
*Attorney, Agent, or Firm*—Kenway & Jenney

[57] ABSTRACT

A snap-acting mechanism such as a switch is constructed with a generally planar blade assembled between mutually spaced portions of a pair of members forming a base. The base includes means extending from one of the portions to the other which operate to stress the blade with precision to render it mechanically bistable as a result of the process of assembling the parts of the mechanism.

25 Claims, 10 Drawing Figures

SNAP-ACTING MECHANISMS

RELATED APPLICATION

This is a continuation-in-part of my copending application Ser. No. 304,866, filed Sept. 23, 1981.

SUMMARY OF THE INVENTION

This invention relates generally to snap-acting mechanisms. More particularly, it relates to mechanisms of the type having a generally planar blade of resilient material that is stressed to render it mechanically bistable, and to the assembly of this blade with other parts to form a switch or other useful snap-acting mechanism. As used herein, the term "snap acting mechanisms" applies broadly to devices in which the restraints on the blade allow it to pass over its center position in operation, and also to devices in which the restraints limit the blade to motions on only one side of its center position toward and away from only one of the two positions of mechanical stability which it could reach in the absence of external restraints.

U.S. Pat. No. 3,213,228 issued to myself and Hadley K. Burch, and U.S. Pat. No. 4,032,734 issued to Hadley K. Burch describe snap-acting mechanisms of the type having a generally planar blade of resilient material formed with a pair of outer legs, one end of each outer leg being connected to one end of the other, and a pair of inner legs between the outer legs, each inner leg having a free end and an end connected to the other end of an outer leg. Such a blade is conveniently formed in a flat, unstressed condition from a thin sheet of electrically conductive material such as phosphor bronze or tempered beryllium copper. The blade is rendered mechanically bistable by applying a force between the inner legs in a direction parallel to the plane of the blade while the free ends of the inner legs are held substantially flat. For example, the force may be applied to spread the inner legs apart by a predetermined distance measured from the unstressed condition. The means for applying this force may comprise a pin having a portion of a diameter selected to provide the desired stress. The pin may also serve to assist in supporting the blade in a position relative to suitable stop means, such as an electrical contact or contacts, that engage the blade when a force is applied to it sufficient to snap it over a center position from one of its positions of stability to the other, and disengage from the blade when the latter is snapped in the reverse direction. Devices of this type have been in successful use for a number of years, and are generally called "M-blade" switches or mechanisms.

As described in the above patents, the operating characteristics of M-blade mechanisms depend upon a number of factors including the choice of materials, the dimensions of the parts and their structural relationships. In order to obtain uniformity in mass production it is important to impose suitable controls on all of these factors. It is important not only that the individual components are manufactured with the desired precision and uniformity, but also that the parts are assembled in a precisely uniform manner. At the same time, attention must be paid to the costs of manufacture including both labor and material costs. The above considerations apply with particular force when unskilled labor is employed in manufacture.

The means chosen for applying the spreading force to the M-blade may affect the resulting snap action characteristics of the blade. For example, if the force is applied by a pin that rotates with respect to the M-blade, this may impart an undesirable torque to the blade. As another example, if the force is applied by means of a rivet, the rivet may impart an undesirable distortion to the blade. In mass production such torque or distortion of the inner legs of the M-blade can result in nonuniformity and lack of precision in the operating characteristics of the final products.

It is a principal object of the present invention to provide M-blade mechanisms that are so constructed as to achieve the desired precision and uniformity in mass production with relatively low material and labor costs.

A further object is to accomplish the foregoing object while still retaining all of the desirable operating features of M-blade mechanisms, described in the above patents.

A still further object is to provide a mechanism constructed of parts so arranged that when assembled to house an M-blade, the latter is automatically stressed into the desired bistable condition by the act of assembly itself.

With the above and other specific objects hereinafter described in view, the features of this invention include, in combination with an M-blade, a base comprising a pair of members secured together and respectively having base portions in spaced facing relationship, the base having positioning means extending from one of the base portions to the other. The positioning means locates and clamps the free ends of the inner legs of the M-blade, and includes spreader means for spreading said free ends apart to stress the blade into a mechanically bistable condition. The configurations and relationships of the parts, including other necessary elements such as stop means for engaging the blade, are such that assembly is greatly facilitated with substantial savings in labor costs. Further, the performance of the steps of assembly to complete the M-blade mechanism automatically results in the application of a precise and uniform stress to the blade in each unit, conforming to the predetermined specifications for the operating characteristics.

DESCRIPTION OF THE DRAWINGS

FIG. 8 is a side elevation of a second form of single pole, single throw thermostat switch embodying the invention.

FIG. 9 is a view in plan taken on line 9—9 of FIG. 8.

FIG. 10 is a side elevation of a third form of single pole, single throw thermostat switch embodying the invention.

DETAILED DESCRIPTION

Figure 2:
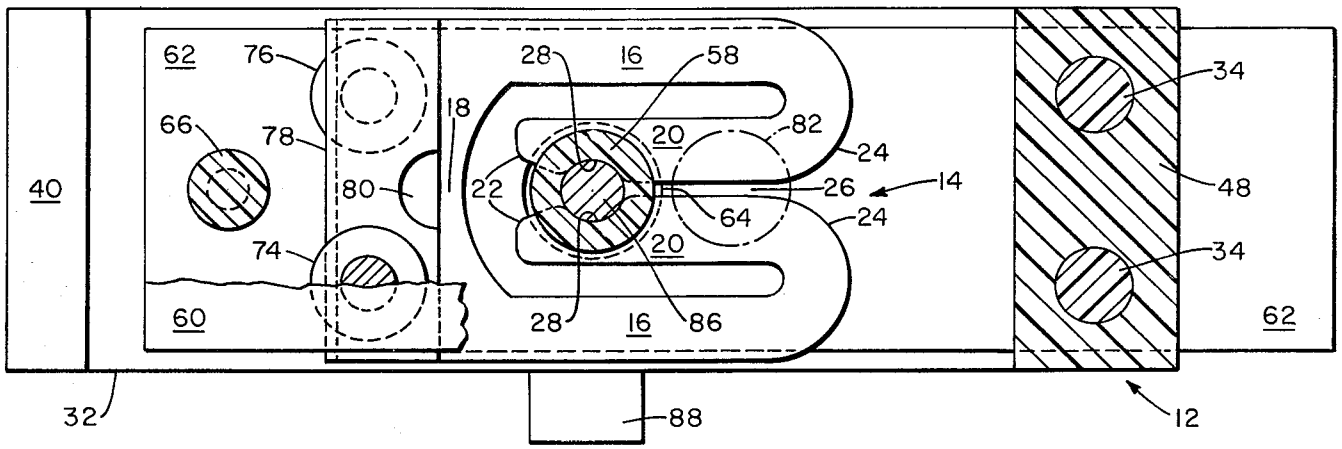
FIG. 2 is a view in plan taken on line 2—2 of FIG. 1.
Figure 1:
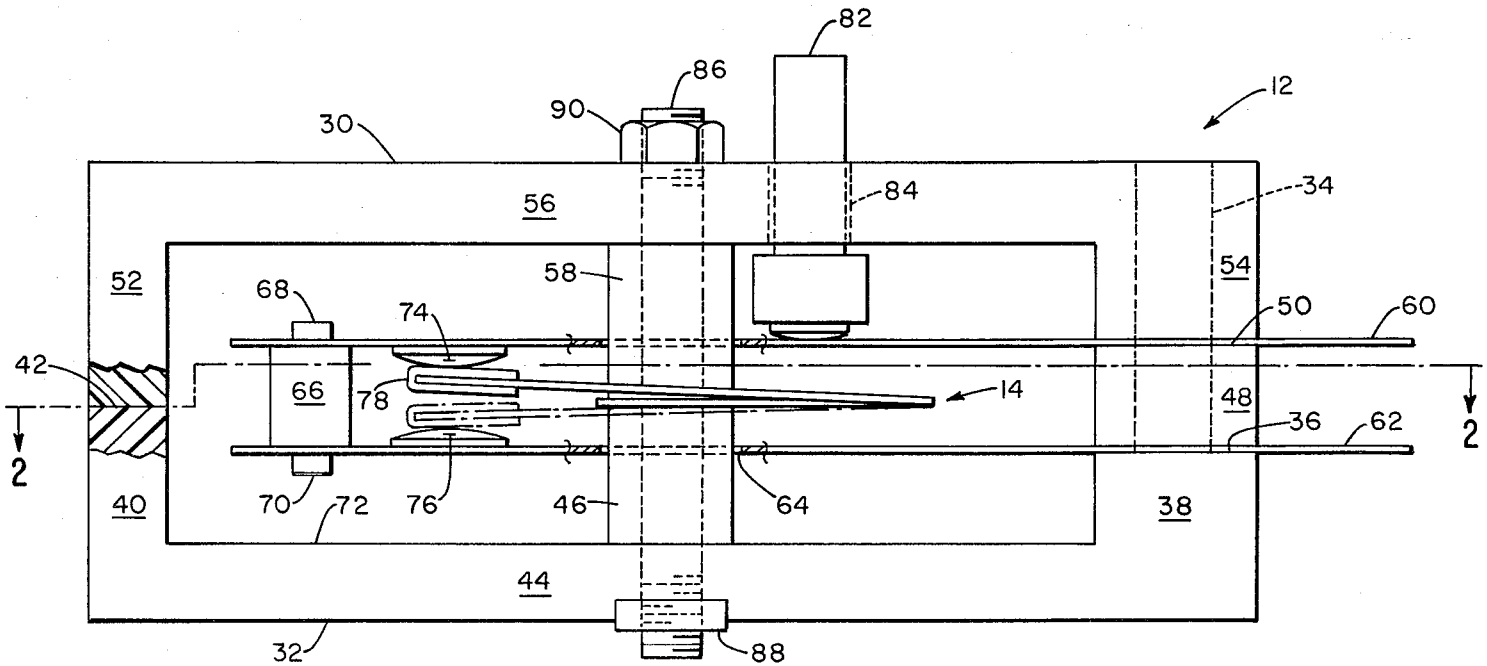
FIG. 1 is a side elevation of a single pole, double throw switch embodying the invention.

FIGS. 1 and 2 illustrate a preferred embodiment of a mechanically actuated single pole, double throw switch according to the invention, designated generally at 12. The switch is shown in fully assembled condition, and includes an M-blade 14 of the type described in the above-mentioned patents. The blade is formed, for example, from a sheet of phosphor bronze or tempered beryllium copper, and is flat in the unstressed condition. The blade has a pair of outer legs 16, one end of each outer leg being connected to one end of the other by an integral bridging portion 18. The blade also has a pair of inner legs 20 between the outer legs, each inner leg having a tapered free end 22 and an end 24 connected to the other end of an outer leg. Preferably, the inner legs are formed with a small space 26 between them, and with edge portions 28 forming arcs of a common circle having a predetermined diameter.

The base of the switch comprises a pair of electrically insulating molded plastic members 30 and 32 formed to be fitted and secured together, the plastic being of the kind commonly used for the manufacture of electrical switches. The member 32 is formed with a pair of integrally-molded pins 34 extending from a surface 36 on an end portion 38. The member 32 also has an opposite end portion 40 with a flat end surface 42. Between the end portions 38 and 40 there is a longitudinal portion 44 with an integral cylindrical upstanding sleeve-like boss 46.

A separator 48 of generally rectangular shape, preferably formed of the same electrically insulating molded plastic material as the members 30 and 32, has holes therein that fit over the pins 34. The separator 48 has a flat lower surface and a flat upper surface 50.

The member 30 has an end portion 52 that fits on the end surface 42, and an end portion 54 having a flat lower surface. The portion 54 has holes to receive the pins 34. The member 30 also has a longitudinal portion 56 with an integral cylindrical sleeve-like boss 58 coaxial with the boss 46. In some embodiments the bosses 46 and 58 can be of a shape other than cylindrical, for example square, rectangular or nonsymmetrical.

The switch 12 has a pair of rectangular flat contact leaves 60 and 62 formed of resilient metal and cantilever mounted between the portions 38, 48 and 54 for spring action. Each of these leaves has a pair of holes fitting over the pins 34 with the separator 48 therebetween. The leaves 60 and 62 also have circular holes such as 64 coaxial with and of larger diameter than the bosses 46 and 58, so as to remain out of contact with the bosses when flexed in directions parallel to the common axis of the bosses during operation. The ends of the leaves 60 and 62 opposite to the pins 34 are spaced apart by an accurately formed insulating separator 66, this separator preferably having ends 68 and 70 of reduced diameter for insertion into corresponding holes in the two leaves. The end 70 may also serve as a stop, limiting the downward motion of the leaves 60 and 62 in operation by engagement with a wall 72 of the member 32.

The leaf 60 has a contact 74 riveted or otherwise attached to its surface, and the leaf 62 also has a contact 76 similarly attached to its surface. Preferably, the contacts 74 and 76 are located opposite the bridging portion 18 of the blade but are not coaxial, that is, one contact is located closer to one of the outer legs 16 of the blade than the other, and the other contact is similarly located closer to the opposite outer leg.

A folded metallic sheet 78 acts as an electrical contact. It is received over the portion 18 connecting the outer legs 16 of the blade, and welded to the blade at 80. This sheet is preferably made of steel with a thin layer of silver bonded to the outer surface thereof which is engageable with the contacts 74 and 76.

The actuator for the switch comprises a push button 82 which is preferably made of electrically insulating material. The push button 82 is slidably received in a hole 84 in the member 30, the button being engageable with the leaf 60.

When the above described elements are fully assembled together as illustrated, the members 30 and 32 are precisely fitted together and the bosses 46 and 58 comprise positioning means that engage opposite sides of the inner legs 20 of the blade, clamping and positioning the blade in an accurately located position between the contacts 74 and 76. The assembly is held together by a single pin 86 fastened at one end to a contact strip 88 by a soldered or riveted connection. The contact strip is recessed in the outer surface of the member 32. The pin has a nut 90 on the opposite end to bear against the portion 56 of the member 30. The pin 86 comprises spreader means passing between the inner legs 20 of the blade, the section of the pin that engages the blade in the fully assembled position having a diameter larger than that of the circle defined by the arcuate edges 28 of the inner legs, spacing them apart a predetermined amount. Thus the blade is rendered mechanically bistable, having two positions of mechanical stability and a center position therebetween. Thus, if the blade is deflected from one of its stable positions toward the other, upon passing through the center position it will immediately snap toward the other stable position.

The switch in this embodiment has a "normal" position with the blade biased to engage the contact 74 when no longitudinal pressure is applied to the actuator push buttom 82. This results from the location of the leaves 60 and 62 relative to the blade. Thus, as viewed in FIG. 1, when no pressure is applied to the button 82, the contact 76 is located so as to apply a sufficient bias force to the blade to snap it from its lower position of stability past the center position to its upper position. In order to snap the switch to its position opposite to "normal", it is necessary to apply sufficient force to the button 82 to deflect the leaves 60 and 62 downwardly a sufficient distance to permit the contact 74 to snap the blade from its upper position of stability past the center position to its lower position, now permitted by the downward movement of the contact 76. When the blade is snapped in this manner, the contact 78 engages the contact 76 and continues to make contact therewith as long as the actuating force is applied.

Figure 5:
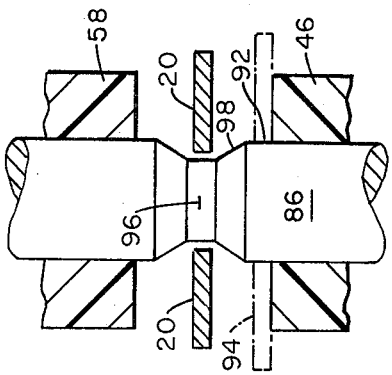
FIG. 5 is a fragmentary elevation illustrating one form of pin for use in practicing the invention.

The assembly of the switch of FIGS. 1 and 2, as well as that of each of the other embodiments described below, is facilitated by forming the pin 86 with sections respectively of smaller and larger diameter than that of the above-described circle defined by the arcuate edge portions 28 of the inner legs 20 of the blade. In assembly, the blade is first placed over the section of smaller diameter, and it is later forced on to the section of larger diameter as the steps of assembly are completed, thereby spreading the inner legs apart the necessary amount to render the blade mechanically bistable. For simplicity of illustration, these sections of smaller and larger diameter are not illustrated in FIGS. 1 and 2, but FIG. 5 shows the presently preferred form. The pin 86 has a section 92 of larger diameter selected to impart the desired stress to the blade when the blade is in a final assembled position designated by broken lines 94. The pin has a section 96 of a diameter slightly less than that of the circle defined by the edge portions 28 of the unstressed blade. In one step of the assembly as represented by solid lines, the blade is located so that the edge portions 28 are located around the section 96. For this purpose the free ends 22 of the inner legs 20 are preferably tapered as shown in FIG. 2 to facilitate their deflection. During a subsequent step of the assembly, when the boss 58 on the member 30 is moved downwardly as viewed in FIG. 5, it forces the blade over a tapered section 98 between the sections 92 and 96 to the final assembled position at 94 in which the blade is positioned on the section 92, thus automatically moving the inner arms apart to apply the correct stress to the blade.

It will be noted that prior to the act of closing the members 30 and 32 together to bring one against the other, the blade is in a totally unstable condition. The blade is put into a bistable condition, as well as being correctly positioned and clamped, when the ends of the bosses clamp the inner ends of the blade and the pin 86 spreads them.

Figure 6:
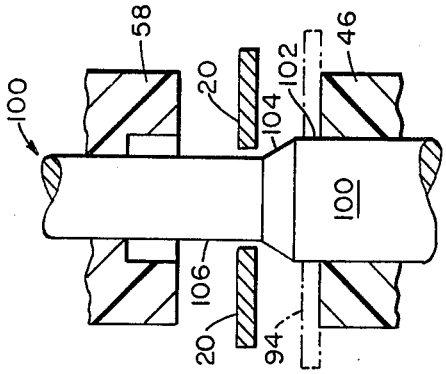
FIG. 6 is a fragmentary view illustrating a second form of pin for use in practicing the invention.

The alternative embodiment of FIG. 6 shows a pin 100 having a section 102 and a tapered section 104 like the sections 92 and 98 of FIG. 5, with a section 106 extending to one end of the pin, the section 106 being of slightly smaller diameter than that of the circle defined by the edge portions 28 of the blade, and the section 102 being of larger diameter than that of the said circle. This permits the blade to be initially assembled over the section 106 by dropping it over the end of the pin. In completion of the assembly, as in the case of FIG. 5, the boss 58 pushes the blade on to the section 102 of the pin.

In assembly of the embodiment of FIGS. 1 and 2, after the pin 86 has been fastened to the contact strip 88, the pin is inserted into position on the member 32 with the strip 88 properly located in the recess on the member 32 as shown. Next, the flat contact leaf 62 is placed over the pins 34, following which the separator 48 is placed over the pins 34. Next, assuming that the pin 86 has the configuration shown in FIG. 5, the blade 14 is inserted over the pin so that the pin passes freely through the space between the tapered ends 22 and the bridging portion 18, and then the blade is pushed laterally into the position shown in solid lines in FIG. 5. If the alternative of FIG. 6 is employed, the blade is simply slipped down over the pin 100 to the position shown in solid lines in that figure. The separator 66 is then placed on the leaf 62. The flat contact leaf 60 is then placed over the pins 34 and the end 68 of the spacer 66 is received through the hole in the leaf 60. The member 30 with the push button 82 in place is then fitted over the end of the pin 86, as well as the pins 34 and closed down toward its final position. After the pin 86 protrudes through the member 30, the nut 90 can be placed on the pin and turned down to seat and secure the members 30 and 32 in their final fitted relationship. As will be evident from FIGS. 5 and 6, the final step of assembly results in automatically positioning the blade on the larger diameter of the pin to apply the necessary predetermined stress to the blade to render it mechanically bistable, and also results in clamping the blade in the correct position. In this step the stress applied to the blade is a purely spreading action, with no torque applied to the blade and no distortion of the inner legs 20.

Another alternative form of pin has a uniform diameter throughout its length that is larger than that of the circle defined by the edge portions 28 of the undeflected blade. When that alternative is employed, the blade is initially inserted over the pin so that the pin passes freely through the space between the tapered ends 22 and the bridging portion 18. Then, after the blade reaches a position near the boss 46, it is pushed laterally to locate the pin within the space between the edge portions 28. The diameter of the pin is such as to cause the deflection of the inner legs 20 out of their unstressed plane. The blade then remains in a completely unstable condition until it is later clamped between the bosses with the inner legs spread apart as described above.

It will be evident that electrical connections to the switch are made by means of the contact strip 88 connected with the blade through the pin 86 by the engagement of the legs 20 of the blade therewith, and by external extensions of the contact leaves 60 and 62.

Many other modifications of the structure of FIGS. 1 and 2 can be made without departing from the spirit or scope of the invention, as required or preferred for many different applications. For example, in the illustrated embodiment the bosses 46 and 58 are integral with the members 32 and 30, respectively. Alternatively, the bosses can be eliminated and replaced by metallic or non-metallic sleeve members of like dimensions, which are positioned on the pin 86 and are separate from the members 30 and 32.

Other modifications permit the elimination of the separator 48 as a separate piece. This can be accomplished, for example, by forming the clamped ends of the contact leaves 60 and 62 of narrower width as viewed in FIG. 2, by making the separator 48 as an integral part of the member 32, and by forming the surfaces 36 and 50 thereof as steps each supporting one of the contact leaves. As another example, the leaf 62 can be mounted on the member 32 by attachment to a portion thereof near its end portion 38, which would also permit the structure formed by the separator 48 to be made integral with the member 32.

In the embodiment of FIGS. 1 and 2, the pin 86 extends through the bosses 46 and 58 and comprises the fastener that secures the assembly together in a precisely predetermined manner. If desired, the members 30 and 32 can be secured together by other or additional means including such means as clamps, screws or rivets, or plastic welding together of the members 30 and 32, as will be apparent to those skilled in the art.

In the embodiment of FIGS. 1 and 2 the pin 86 is assembled with the member 32 during an early step of the assembly. In an alternative arrangement the initial steps of assembly are as described above with the pin 86 being omitted, and after the members 30 and 32 have been fitted together and the blade clamped between the bosses 46 and 58, the pin 86 is then driven through the members 30 and 32 to the position illustrated, thereby spreading the blade. This is best accomplished with a pin that is precisely ground and unthreaded, with the members 30 and 32 being secured together either by a force fit with the pin itself or by one of the alternative securing means mentioned above.

If desired, the actuator means can be located to apply a force directly to the blade itself, rather than to a contact leaf that transfers a corresponding force to the blade through the contact 74 itself. However, distinct advantages are obtained by the illustrated arrangement, particularly including the fact that contact pressure is maintained high up to the moment when the blade is snapped toward its opposite stable position.

In each of the several embodiments of the invention described herein, there is provided a base comprising a pair of members such as the members 30 and 32 that respectively have base portions such as 56 and 44 in spaced facing relationship with positioning means including the bosses 46 and 58, extending from one of the said base portions to the other and locating and clamping the free ends of the inner legs 20 of the blade. The positioning means also includes spreader means such as the pin 86 that spreads the free ends of the inner legs 20 apart to render the blade mechanically bistable. Each of the several alternative embodiments also includes stop means such as the contact 74 supported on the base in position to engage the blade in a position between one of its stable positions and the center position. The structure is such that the performance of the last step of assembling together of the parts of the mechanism automatically produces a precise and purely spreading movement of the inner legs of the M-blade, thereby stressing it into a bistable condition and making it possible to have precision and uniformity in the mass production of inexpensive switches of the snap-acting type.

Figure 3:
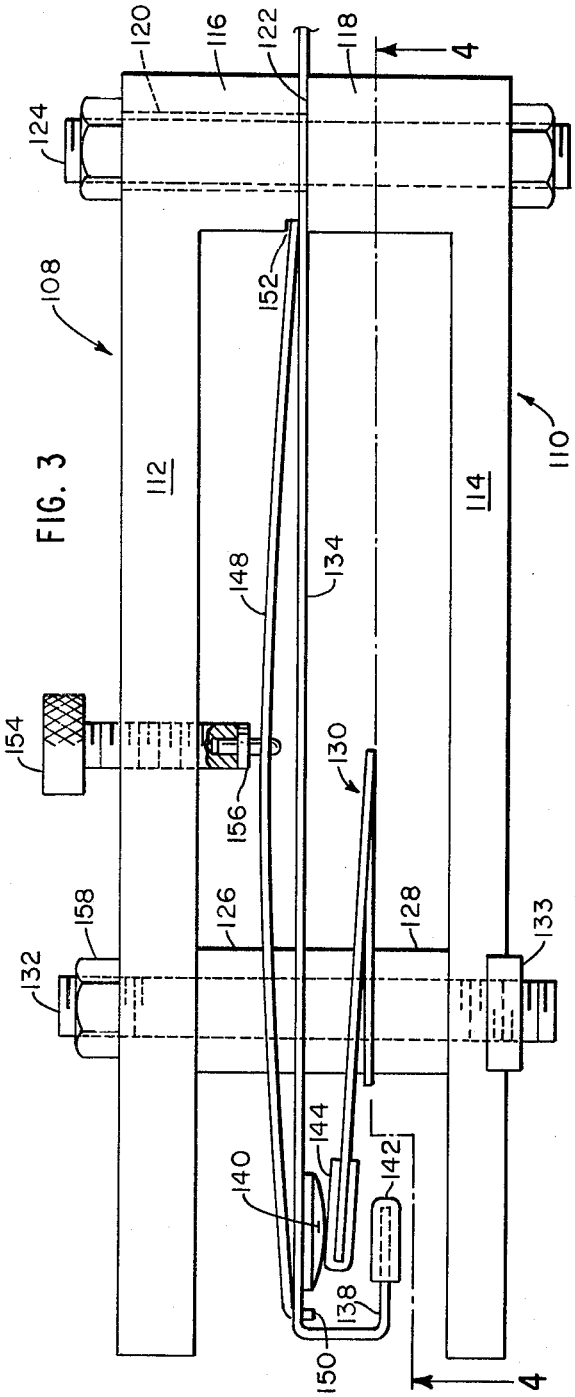
FIG. 3 is a side elevation of a first form of single pole, single throw thermostat switch embodying the invention.
Figure 4:
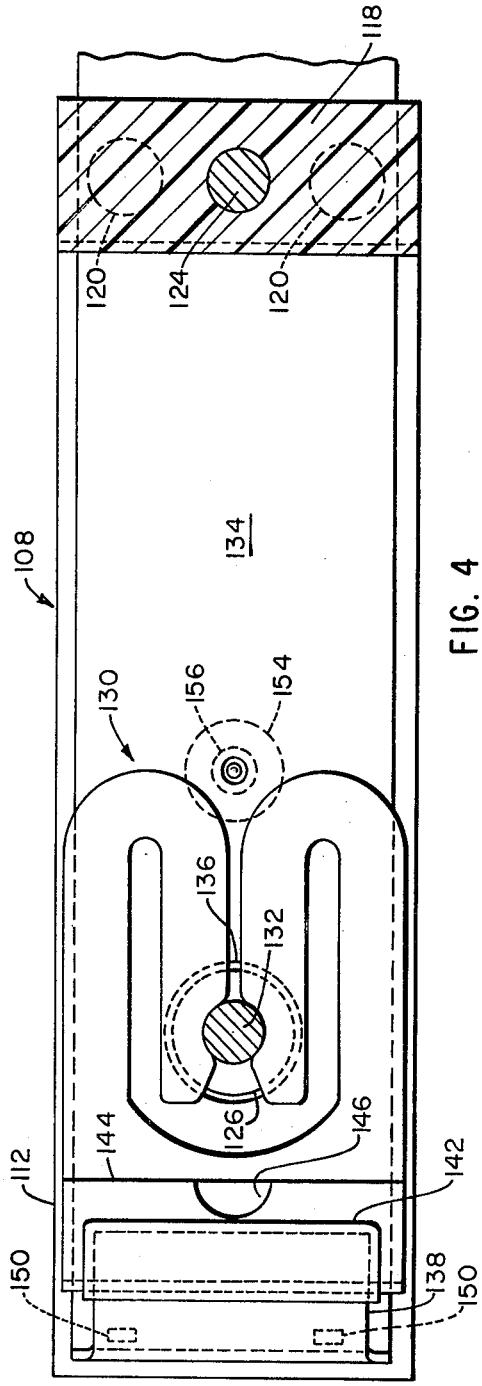
FIG. 4 is a bottom view taken on line 4—4 of FIG. 3.

FIGS. 3 and 4 illustrate a simply constructed but accurate, reliable and adjustable single pole, single throw thermostatic switch according to this invention. This switch is provided with a base comprising a pair of molded plastic members 108 and 110. These members comprise mutually spaced apart portions 112 and 114 and end portions 116 and 118. The portion 118 has a pair of integral pins 120 extending from a flat surface 122, and the end portion 116 has corresponding holes fitting over these pins. Further means for securing the members 108 and 110 together comprise a screw 124 with corresponding nuts.

The members 108 and 110 have respective integral bosses 126 and 128 between which an M-blade 130 like the blade 14 of FIGS. 1 and 2 is clamped. A pin 132 extending through the members 108 and 110 is the same in structure and function as the pin 86 of FIGS. 1 and 2, and is secured to a contact strip 133 like the contact strip 88 of FIGS. 1 and 2.

A rectangular contact leaf 134 of sheet metal, formed with three holes to fit over the pins 120 and the screw 124, respectively, also has a circular hole 136 of larger diameter than the bosses 126 and 128 to permit the leaf to be deflected axially of the pin 132 without contacting the bosses. The leaf 134 has an end portion 138 folded back to a position opposing a contact 140 riveted or otherwise attached to the leaf. An insulating molded plastic cap is inserted over the end of the portion 138 to provide an electrically insulating stop 142 for the blade. As in the embodiment of FIGS. 1 and 2, the blade is provided with a folded sheet metal contact piece 144 welded thereto at 146.

A rectangular bimetallic strip 148 of slightly curved configuration, forming a strip of thermostatic metal, has end tabs 150 inserted in corresponding slots punched in the contact leaf 134. The other end of the strip 148 is inserted in a groove 152 formed in the end portion 116 of the member 108. An adjusting screw 154 with a knurled knob is threaded in the member 108. The screw has a blind axial end hole in which is received a pin 156 of insulating material, the pin having an integral flange abutting the end of the screw. The pin is slidably inserted in a hole in the strip 148. The flange forms an abutment adjustably limiting the upward movement of the strip 148 in response to a change of temperature. The side of the strip 48 having the metal with the greater coefficient of thermal expansion is facing the screw 154, as shown.

In operation, the thermostatic switch as viewed in FIG. 3 is biased to a "normal" position corresponding to a temperature below the set temperature. The assembled position of the contact leaf 134 relative to the blade 130 is such that the insulating stop 142 is enabled to apply a bias force to the blade sufficient to snap it from its lower position of stability as viewed in FIG. 3 to its upper position of stability. In this position and condition of the switch, the contact leaf 134 is undeflected and the blade 130 is in electrical connection with the contact 140. The bimetallic strip is out of contact with the flange on the pin 156.

An increase of temperature then causes the bimetallic strip 148 to elongate faster on one side than the other, so that it assumes a greater curvature. This bending causes the strip to approach the flange on the pin 156. At a predetermined temperature the strip 148 reaches the flange. Any further increase of temperature causes further bending but the strip cannot rise further at the pin 156; therefore, the strip pushes the contact 140 downwardly to apply a downward force to the blade 130. When the resulting downward motion of the blade has continued a sufficient distance, the blade snaps through the center position toward its other position of stability, out of engagement with the contact 140, thus opening any circuit connected to the outer free end of the contact leaf 134 and to the contact strip 133.

It will be apparent that a single pole, double throw thermostatic switch may also be constructed according to this invention by providing a second contact leaf as in the embodiment of FIGS. 1 and 2.

The assembly of the embodiment of FIGS. 3 and 4 is similar in principle to that of FIGS. 1 and 2. First, after the pin 132 has been fastened to the contact strip 133, the pin 132 is inserted into the member 110. Then, the blade 130 is placed over, or snapped onto, the pin 132 near the end of the boss 128. The contact leaf 134 is then placed over the pins 120, and the bimetallic element 148 is placed over the leaf 134 with the tabs 150 inserted in the slots on the leaf 134. The member 108 is then placed over the pins 120 with the pin 156 inserted in the hole on the bimetallic strip 148. The pin 132 preferably has sections of larger and smaller diameter, as in the embodiments of FIGS. 5 or 6, whereby the blade 130 is suitably clamped between the bosses and stressed as in the previously-described embodiments. The assembly is held together by tightening of an assembly nut 158 and the nut on the screw 124.

Figure 7:
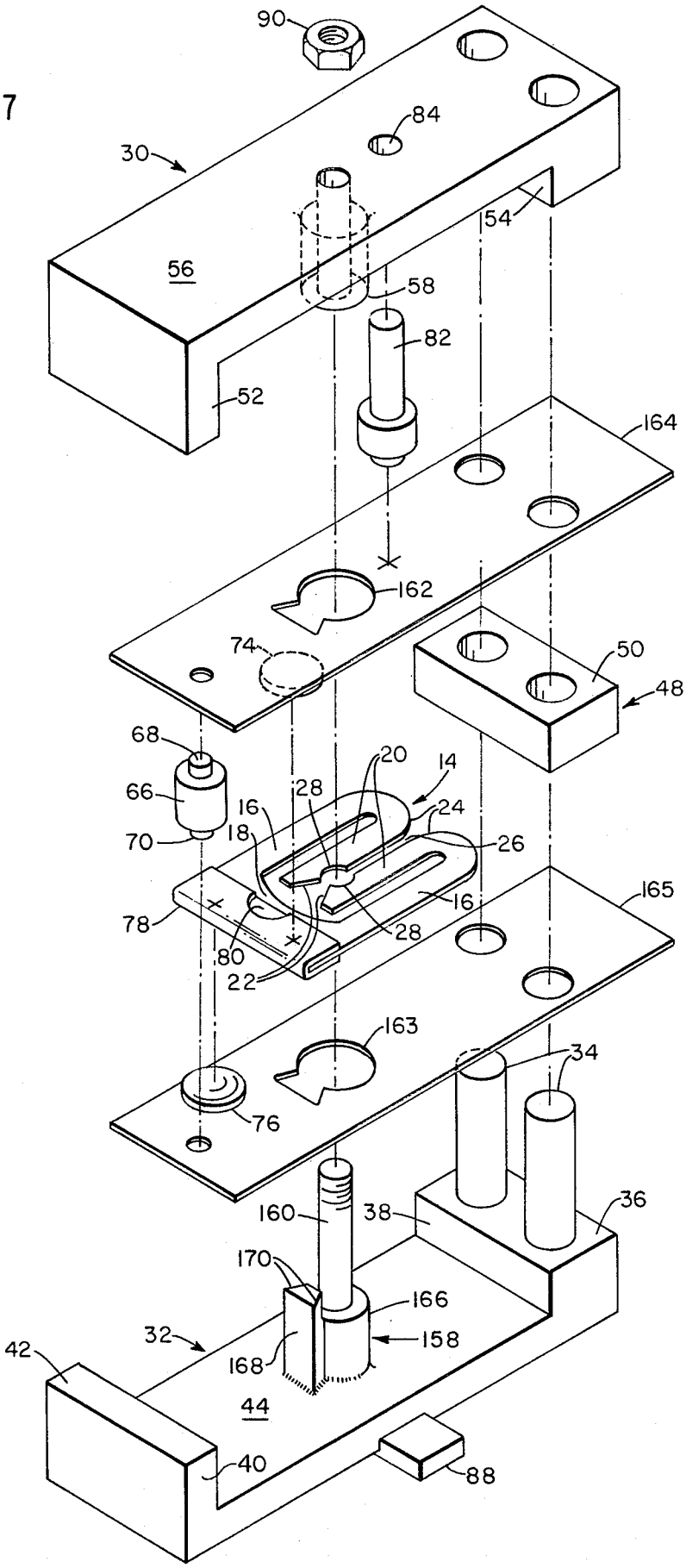
FIG. 7 is an exploded view illustrating the assembly of an embodiment of the invention having a splined boss.

FIG. 7 illustrates an embodiment of a single pole, double throw switch that is identical to that of FIGS. 1 and 2 except for an alternative, splined boss 158 which is substituted for the boss 46, a pin 160 of a uniform diameter that is larger than that of the circle defined by the edge portions 28 of the undeflected blade, and keyhole-shaped apertures 162 and 163 in contact leaves 164 and 165, which are substituted for the leaves 60 and 62. Like parts in FIGS. 1, 2 and 7 are like numbered. The boss 158 guides the blade, during assembly, into linear alignment with the base, thus preventing chance engagement between the blade and any side (not shown) of the base.

More specifically, the boss 158 has a major portion 166 which is cylindrical and which has an axial hole to receive the pin 160 as in the previously described embodiments. The boss 158 also has a minor portion 168 having a trapezoidal cross section with inclined sides 170 sloped like the tapered ends 22 of the inner legs of the blade 14. The dimension of the trapezoid should be such as to allow the blade to fit over it.

When the blade is first positioned on the pin 160, the pin is freely received in the space defined between the tapered ends 22 and the briding portion 18. When the blade is just above the portion 168 of the boss, it is pushed laterally to locate the pin within the space between the edge portions 28. The blade may then pass down over the end of the portion 168 and will be aligned with the side walls of the base and also with the contact leaves 164 and 165. The apertures 162 and 163 in the latter are formed to fit freely without contact over the boss 158.

If desired, the portion 168 may be shortened so that it does not extend to the upper contact leaf 164 in the final assembly, in which case the aperture 162 can be simply a round hole.

In the embodiment of FIG. 7, any engagement between the tapered ends 22 of the blade and the portion 168 is inconsequential because the bosses clamp these ends when the assembly is completed. However, the possibility of frictional engagement between the outer legs of the blade and the case walls during operation has been eliminated.

In the embodiments of FIGS. 1 to 4 and 7, actuator means are provided to apply an operating force to the M-blade to deflect it in the direction from one of its stable positions over the center position toward the other stable position. FIGS. 8 to 10 illustrate two embodiments in which no separate actuator means is required, the operation of the devices resulting from inherent properties of the M-blade.

FIGS. 8 and 9 illustrate a single pole, single throw thermostat switch of the automatic reset type. An M-blade 172 is formed of a bimetallic sheet in the same configuration as the blade 14 of FIG. 1. The base comprises a pair of members 174 and 176 of insulating material having portions in spaced facing relationship with integral bosses 178 and 180, respectively. The member 176 has integral locating pins 182 fitting in corresponding holes 184 in the member 174. A metal contact leaf 186 has a U-shaped bent portion 188 force fitted in a corresponding slot 190 in the member 176. A contact 192 is secured to an end of the leaf 186.

The assembly is held together by a pin 193 having at its opposite ends a contact strip 194 and a nut 196.

The blade 172 is oriented with the metal of higher thermal coefficient on the side facing the contact 192, and preferably has a folded metallic sheet 198 like the sheet 78 of FIG. 1.

The member 176 has an integral projecting stop 200 located to abut the sheet 198 when the blade 172 is slightly closer to the contact 192 than it would be in its center position. That is, the stop 200 prevents the blade from passing through the center position.

In operation, at a sufficiently low temperature the blade is at rest against the contact 192. Upon an increase in the temperature of the blade, it bends because of the difference in thermal coefficients of its two metallic components, as is well known, ultimately separating from the contact 192. Upon cooling, the blade returns to the original position. The switch is automatically reset, that is, it does not require the application of a mechanical force to return it to the closed position when the temperature returns to the original value. In this embodiment, the pin 193 applies a stress to the blade to render it mechanically bistable, as in the above-described embodiments.

FIG. 10 also shows a single pole, single throw thermostat switch. In this embodiment, the switch is reset by means of a push button 202 slidable in one of two base portions 204 and 206. The base portions are held together by a pin 208 having a contact strip 210 and nut 212. The base portions 204 and 206 have integral bosses 214 and 216, respectively, clamping a bimetallic M-blade 218. This blade may be exactly the same as the blade 172 of FIGS. 8 and 9, with a folded metallic sheet 220. There is also provided a contact leaf 222 fastened to a contact 224 and mounted in the same manner as the corresponding parts of FIGS. 8 and 9.

In the operation of the embodiment of FIG. 10, the metal of higher thermal coefficient is located on the side facing the contact 224. At a sufficiently low temperature the blade 218 and contact 224 are in contact as shown. As the temperature increases, the blade moves toward its center position. As the temperature continues to increase further, the blade moves through the center position, whereupon it snaps into contact with the push button 202. Once the blade is in contact with the push button, it does not automatically return to its original position upon cooling to the original temperature because the force required to push it past the center position exceeds that which is produced by the thermal deflection characteristics of the blade. Resetting of the switch is accomplished by depressing the push button mechanically.

In the embodiments of FIGS. 8 to 10, thermostatic response is a function of the temperature of the blade. If desired, this temperature may be the ambient temperature in which the switch is placed. Alternatively, since the blade forms part of the electrical circuit connecting the contact leaf 186 (or 222) with the strip 194 (or 210), heat may be generated in the blade by the flow of current through it. The amount of heat generated by the current in the blade is a function of its ohmic resistance, which is in turn a function of the choice of metals forming the blade and their physical dimensions.

In the several described embodiments of the present invention, as well as other obvious modifications, all of the desirable features of the M-blade snap action mechanism, described in the above-mentioned patents, are realized. These include the following:

(1) long life resulting from the durability of the parts and the proper distribution of stresses during operation, which minimizes fatigue failure;

(2) inexpensive manufacture resulting from the simplicity and small number of the parts, further substantially improved in the present invention by the simplicity of assembly of a number of flat elements and the automatic controlled stressing of the blade during the performance of the steps of assembly;

(3) high current carrying capacity and electrical rating for a given switch size resulting from the high contact pressures maintained up to the point of snapping the switch;

(4) small force or movement required for sensitive actuation;

(5) little or no contact bounce during closing, particularly in the embodiments such as that of FIGS. 1 and 2 where the contacts or stop means are non-coaxial as taught in said Pat. No. 4,032,734; and (6) large contact separation during opening to provide a large current rupturing capacity.

I claim:

1. In a snap acting mechanism having a generally planar blade of resilient material formed with a pair of outer legs, one end of each outer leg being connected to one end of the other, and a pair of inner legs between the outer legs, each inner leg having a free end and an end connected to the other end of an outer leg, the combination with said blade of a base comprising a pair of members secured together and respectively having base portions in spaced facing relationship, the base having positioning means extending from one of said base portions to the other, the positioning means locating and clamping said free ends in a predetermined position between said base portions and including spreader means for spreading said free ends apart to stress the blade into a condition having two stable positions and a center position therebetween, and stop means on the base in position to engage the blade in a position between one of said stable positions and said center position.

2. The combination of claim 1, in which the blade is a bimetallic sheet.

3. The combination of claim 2 including means to restrain the blade from movement past the center position.

4. The combination of claim 2 including a pair of stop means respectively located to engage the blade in positions between each of said stable positions and said center position, at least one of said stop means being depressable to snap the blade past the center position.

5. The combination of claim 1 with actuator means adapted to apply an operating force to the blade of sufficient magnitude to snap it from one of said stable positions to the other.

6. The combination of claim 1, in which the positioning means is adapted to secure the pair of members together.

7. The combination of claim 1, in which the positioning means includes a pair of elements each extending from one of the base portions to the blade, said free ends being clamped between said elements.

8. The combination of claim 7, in which each of said elements is integral with one of said pair of members.

9. The combination of claim 1, in which the spreader means is a pin extending between said free ends.

10. The combination of claim 9 in which the pin extends through said pair of members, and including means to stress the pin in tension to secure said members together.

11. The combination of claim 9, in which the positioning means includes sleeve means, the pin extending through the sleeve means.

12. The combination of claim 11, in which the sleeve means comprise a pair of sleeve elements each extending from one of said base portions to the blade, said free ends being clamped between the sleeve elements.

13. The combination of claim 12, in which the sleeve elements comprise integral bosses on the respective members.

14. The combination of claim 12, in which the pin has sections of differing diameters, the sleeve being dimensioned to position the blade on the section of larger diameter when said members are secured together.

15. The combination of claim 14, in which said free ends have respective edges forming arcs of a common circle larger in diameter than the section of smaller diameter and smaller in diameter than the section of larger diameter.

16. The combination of claim 5, in which the actuator means is adapted to apply a variable force between the base and a surface of the blade at a position spaced from said free ends.

17. The combination of claim 5, in which the actuator means comprises an element adapted to move in response to a change in its temperature, and mounted on the base in position to apply its motion to the blade.

18. The combination of claim 5, in which the actuator means is adapted to apply said force to the blade through the stop means.

19. The combination of claim 18, in which the stop means comprises a strip of resilient material supported by the base and extending between said pair of members, the actuator means being located to deflect the stop means.

20. The combination of claim 19, in which the stop means comprises a sheet of metal and said pair of members are respectively shaped to clamp said sheet therebetween when secured together.

21. The combination of claim 1, in which the stop means comprises an electrical contact.

22. The combination of claim 9, in which the stop means comprises an electrical contact, the pin and stop means having mutually electrically insulated terminals on the base for external connection.

23. The combination of claim 22, in which the electrical contact is located to engage the blade in closer proximity to one of said outer legs than to the other.

24. The combination of claim 1, in which the stop means comprises a strip of resilient material supported by the base and extending between said base portions, said strip having a portion located to apply a bias force sufficient to snap the blade past said center position.

25. The combination of claim 12, in which said free ends are formed to define first edge portions for receiving the pin therebetween and second edge portions between the first edge portions and the extremities of said free ends, the second edge portions being mutually spaced, one of the sleeve elements having a clamping surface for clamping said free ends and a key portion extending axially from the clamping surface and shaped to pass between the second edge portions of the blade.

* * * * *